US006590486B2

(12) United States Patent
Tanaka et al.

(10) Patent No.: US 6,590,486 B2
(45) **Date of Patent: *Jul. 8, 2003**

(54) MULTILAYER INDUCTOR

(75) Inventors: Tadashi Tanaka, Shiga-ken (JP); Hiromichi Tokuda, Omihachiman (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/144,078

(22) Filed: May 13, 2002

(65) Prior Publication Data

US 2003/0001711 A1 Jan. 2, 2003

(30) Foreign Application Priority Data

Jun. 27, 2001 (JP) ..... 2001-195491

(51) Int. Cl.[7] ..... H01F 27/02
(52) U.S. Cl. ..... 336/83; 336/200
(58) Field of Search ..... 336/65, 83, 200, 336/206–208, 192, 221, 222, 223, 232; 29/602.1, 609; 257/531

(56) References Cited

U.S. PATENT DOCUMENTS 6,147,573 A * 11/2000 Kumagai et al. ..... 336/200
6,189,200 B1 * 2/2001 Takeuchi et al. ..... 336/200
6,489,875 B1 * 12/2002 Uchikoba et al. ..... 336/200

FOREIGN PATENT DOCUMENTS

JP 5-335148 * 12/1993
JP 2001-102219 * 4/2001

* cited by examiner

*Primary Examiner*—Tuyen T. Nguyen
(74) *Attorney, Agent, or Firm*—Keating & Bennett, LLP

(57) ABSTRACT

A multilayer inductor includes first and second conductive coil patterns which are disposed in two layers in an upper portion of a multi-layered body and are electrically connected consecutively in series to third and fourth conductive coil patterns disposed in a lower portion of the multi-layered body through via-holes formed in an insulation sheet, thereby forming a spiral coil. The first conductive coil patterns and the second conductive coil patterns overlap each other at edges thereof. The fourth conductive coil patterns and the third conductive coil patterns overlap each other at edges thereof.

10 Claims, 11 Drawing Sheets

MULTILAYER INDUCTOR

BACKGROUND OF THE INVENTION

1. Field of the Invention

The present invention relates to multilayer inductors, and, in particular, to a multilayer inductor preferably for use as an EMI (electromagnetic interference) filter or other suitable filter.

2. Description of the Related Art

Multilayer inductors such as a multilayer inductor 1 shown in FIG. 10 are known. The multilayer inductor 1 is constructed such that an insulation sheet 2*b* provided with conductive coil patterns 3*a* to 3*e* disposed thereon, an insulation sheet 2*d* provided with conductive coil patterns 4*a* to 4*f* disposed thereon, and an insulation sheet 2*c* provided with a plurality of via holes formed therein are laminated on each other and are sintered integrally with each other to define a multi-layered body. The multilayer inductor 1 shown in FIG. 10 is provided with lead electrodes 5 and 6.

The conductive coil patterns 3*a* to 3*e* disposed in the upper portion of the multi-layered body and the conductive coil patterns 4*a* to 4*f* disposed in the lower portion of the multi-layered body are each formed in one layer. The conductive coil patterns 3*a* to 3*e* and 4*a* to 4*f* are electrically connected in series to each other via a plurality of the via holes 8 formed in the insulation sheets 2*b* and 2*c* so as to define a spiral coil L. The axis of the spiral coil L is perpendicular to the lamination direction of an insulation sheet 2*a* and the insulation sheets 2*b* to 2*d* and to the extension direction of external input-output electrodes 10 and 11 (see FIG. 11). That is, the axis of the spiral coil L is parallel to the mounting surface of the multilayer inductor 1.

In such a known multilayer inductor, since the conductive coil patterns 3*a* to 3*e* disposed in the upper portion of a multi-layered body 9 and the conductive coil patterns 4*a* to 4*f* disposed in the lower portion of the multi-layered body 9 are individually formed on the same layers, gaps are formed between the adjacent conductive coil patterns (for example, between the conductive coil patterns 3*a* and 3*b*), whereby magnetic fluxes $\phi$ generated by the spiral coil L leak through the gaps.

SUMMARY OF THE INVENTION

In order to overcome the problems described above, preferred embodiments of the present invention provide a multilayer inductor in which leakage of magnetic fluxes is prevented and very high inductance is achieved.

According to a preferred embodiment of the present invention, a multilayer inductor includes a multi-layered body including a plurality of insulation layers stacked on each other and laminated together, a plurality of conductive coil patterns disposed in an upper portion of the multi-layered body, a plurality of conductive coil patterns disposed in a lower portion of the multi-layered body, and a plurality of via holes provided in the multi-layered body. The conductive coil patterns disposed in the upper portion and the lower portion of the multi-layered body are electrically connected in series to each other through the via holes so as to define a coil. The axis of the coil is substantially perpendicular to the stacking direction of the insulation layers. Each of the pluralities of conductive coil patterns disposed in the upper portion and the lower portion of the multi-layered body or a plurality of the conductive coil patterns disposed either in the upper portion or in the lower portion of the multi-layered body is formed in and located at different layers. Each conductive coil pattern formed in and located at one of the different layers partially overlaps the conductive coil patterns formed in and located at the other layers.

According to another preferred embodiment of the present invention, a multilayer inductor includes a first insulation layer provided thereon with a plurality of first coil conductors, a second insulation layer provided thereon with a plurality of second coil conductors, a third insulation layer provided thereon with a plurality of third coil conductors, a fourth insulation layer provided thereon with a plurality of fourth coil conductors, and a plurality of via holes for electrically connecting the first, second, third, and fourth coil conductors in series to each other so as to define a coil. A multi-layered body is defined by the first, second, third, and fourth insulation layers which are stacked on each other such that the first and second coil conductors are disposed in an upper portion of the multi-layered body and the third and fourth coil conductors are disposed in a lower portion thereof. The axis of the coil is substantially perpendicular to the lamination direction of the insulation layers, the coil being defined by the coil conductors which are disposed in the upper portion and the lower portion of the multi-layered body and which are electrically connected alternately to each other in series, the second coil conductors overlap gaps formed between each first coil conductor, and the third coil conductors overlap gaps formed between each fourth coil conductor.

In the multilayer inductor according to preferred embodiments of the present invention, each of the pluralities of conductive coil patterns disposed in the upper portion and the lower portion of the multi-layered body or a plurality of the conductive coil patterns disposed in the upper portion or the lower portion of the multi-layered body is formed in and disposed at at least two layers. With this arrangement, gaps formed between each conductive coil pattern disposed in one layer can be covered with the conductive coil patterns disposed in the other layer, whereby leakage of magnetic fluxes can be significantly decreased. In this case, the width of the conductive coil patterns disposed in the outer layer of the at least two layers is preferably greater than the width of the conductive coil patterns disposed in the inner layer.

When at least one nonmagnetic layer is disposed between the different layers provided with the conductive coil patterns, no magnetic paths are provided at the nonmagnetic layer, whereby the leakage of magnetic fluxes is further decreased.

According to various preferred embodiments of the present invention, a multilayer inductor in which leakage of magnetic fluxes is minimized and high inductance is achieved is thus provided.

Other features, elements, characteristics and advantages of the present invention will become more apparent from the following detailed description of preferred embodiments with reference to the attached drawings.

DETAILED DESCRIPTION OF PREFERRED EMBODIMENTS

Preferred embodiments of a multilayer inductor according to the present invention are described below with reference to the drawings.

Figure 1:
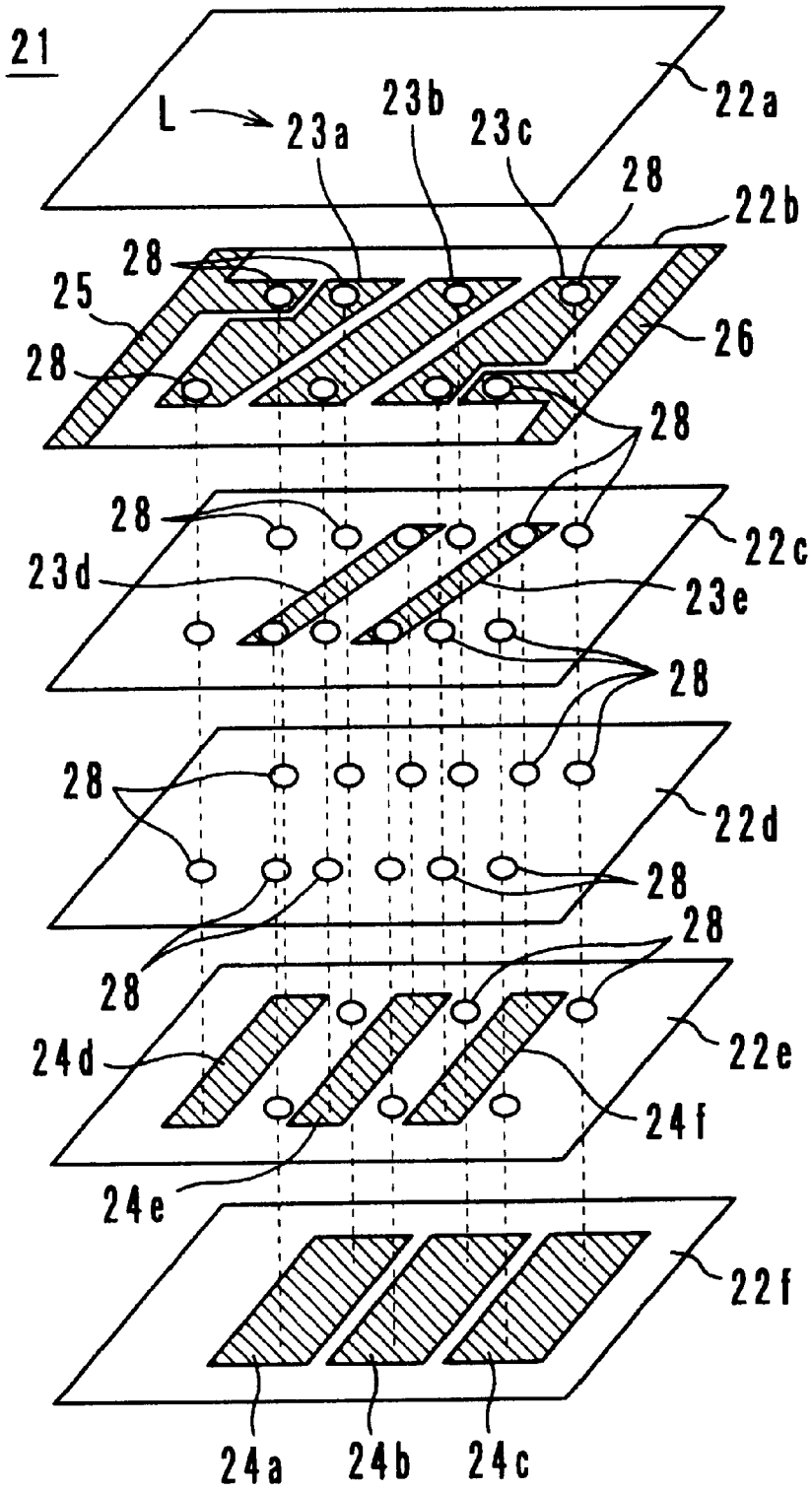
FIG. 1 is an exploded perspective view of a multilayer inductor according to a first preferred embodiment of the present invention.

In FIG. 1, a multilayer inductor 21 includes a first insulation sheet 22*b* provided thereon with first conductive coil patterns 23*a* to 23*c* and conductive lead-terminal patterns 25 and 26, a second insulation sheet 22*c* provided thereon with second conductive coil patterns 23*d* and 23*e*, an insulation sheet 22*d* having a plurality of via holes 28 formed therein, a third insulation sheet 22*e* provided thereon with third conductive coil patterns 24*d* to 24*f*, and a fourth insulation sheet 22*f* provided thereon with fourth conductive coil patterns 24*a* to 24*c*.

The conductive patterns 23*a* to 23*c* and 25 and 26, 23*d* and 23*e*, 24*d* to 24*f*, and 24*a* to 24*c* are formed on the insulation sheets 22*b*, 22*c*, 22*e*, and 22*f*, respectively, preferably by a method such as printing, sputtering, vapor deposition, or photolithography, or other suitable method. Silver, a silver-palladium alloy, palladium, copper, nickel, or other suitable material is used as a material of the conductive coil patterns 23*a* to 23*e*, 24*a* to 24*f*, 25, and 26. An insulation sheet 22*a* and the insulation sheets 22*b* to 22*f* are formed as sheets of a magnetic material such as ferrite, or dielectric or insulative material such as a ceramic being kneaded with a binder.

The via holes 28 are formed such that holes for defining the via holes 28 are firstly formed in the insulation sheets 22*b* to 22*e* preferably by laser-beam machining or punching, then, the holes for the via holes are filled with a conductive paste. The first conductive coil patterns 23*a* to 23*c* and the second conductive coil patterns 23*d* and 23*e* are disposed in the upper portion of a multi-layered body 30 which is described below. The third conductive coil patterns 24*d* to 24*f* and the fourth conductive coil patterns 24*a* to 24*c* are disposed in the lower portion of the multi-layered body 30.

The first and second conductive coil patterns 23*a* to 23*e* disposed in the upper portion and the third and fourth conductive coil patterns 24*a* to 24*f* disposed in the lower portion are electrically connected in series to each other though the via holes 28 formed in the insulation sheets 22*b* to 22*e* so as to define a spiral coil L. That is, the conductive patterns are connected one after another in order of the conductive lead-terminal pattern 25, the conductive coil patterns 24*d*, 23*a*, 24*a*, 23*d*, 24*e*, 23*b*, 24*b*, 23*e*, 24*f*, 23*c*, and 24*c*, and the conductive lead-terminal pattern 26. The axis of the spiral coil L is substantially perpendicular to the lamination direction of the insulation sheets 22*a* to 22*f* and to the extension direction of input-output electrodes 31 and 32 which are described below. That is, the axis of the spiral coil L is substantially parallel to the mounting surface of the multilayer inductor 21.

Figure 2:
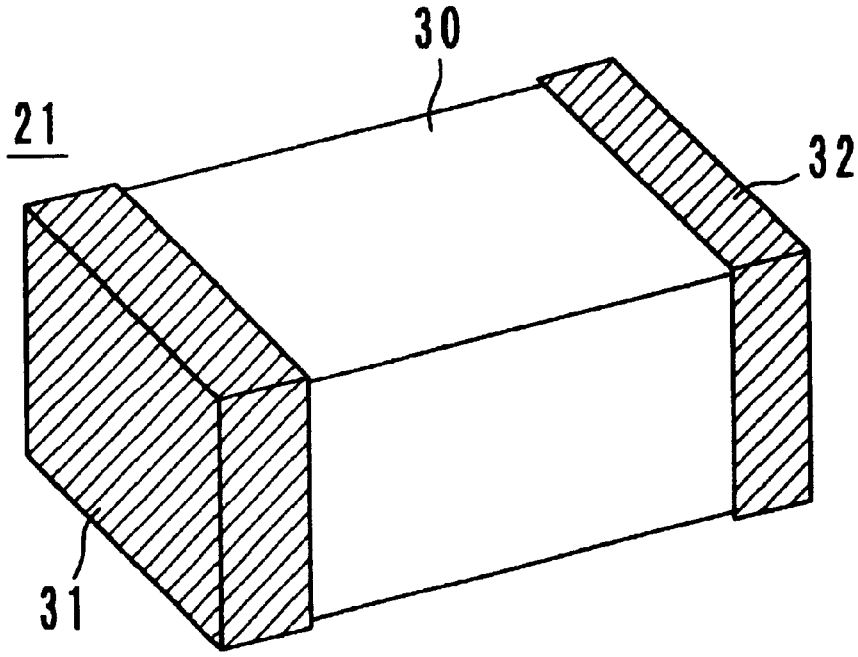
FIG. 2 is a perspective view of the multilayer inductor shown in FIG. 1.

The insulation sheets 22*a* to 22*f* laminated on each other are sintered integrally with each other so as to define the multi-layered body 30 shown in FIG. 2. The multi-layered body 30 is provided at ends thereof with the input-output electrodes 31 and 32. The input-output electrodes 31 and 32 are electrically connected to the conductive lead-terminal patterns 25 and 26, respectively. The input-output electrodes 31 and 32 are formed such that a conductive paste made of a material such as silver, a silver-palladium alloy, or copper, or other suitable material, is applied by baking or dry plating, or other suitable process.

Figure 3:
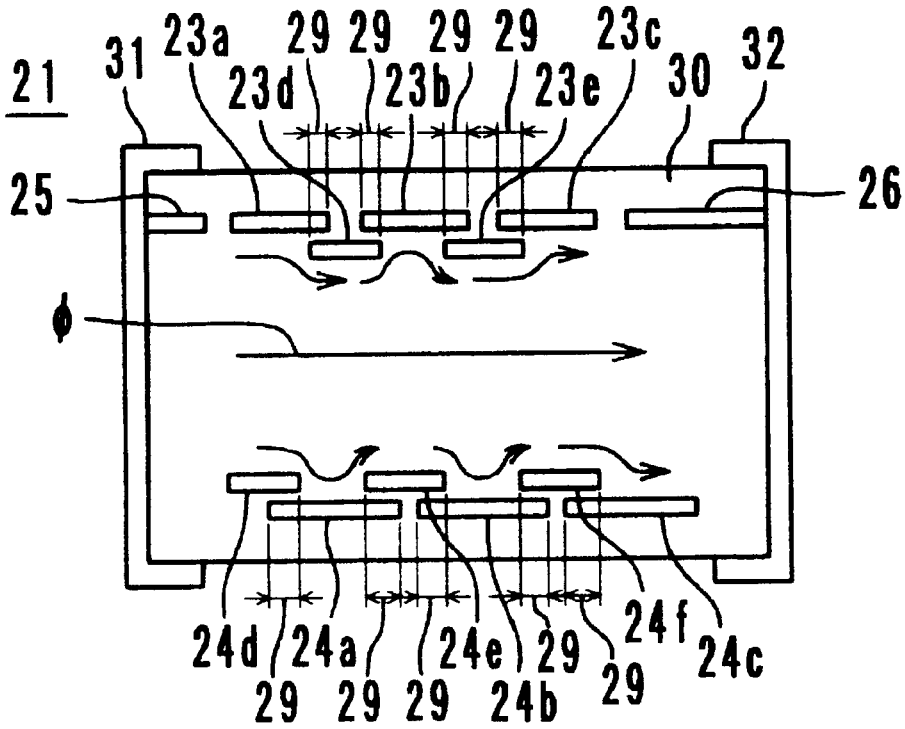
FIG. 3 is a schematic sectional view of the multilayer inductor shown in FIG. 2.
Figure 4:
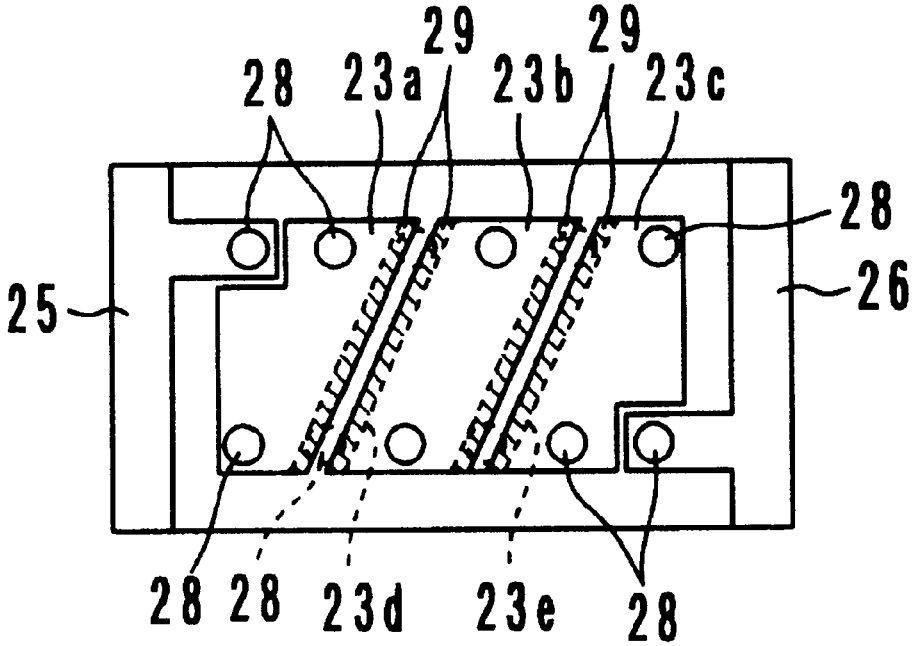
FIG. 4 is an internal plan view showing the position of first and second conductive coil patterns.

FIG. 3 is a schematic sectional view of the multilayer inductor 21. The first conductive coil patterns 23*a* to 23*c* and the second conductive coil patterns 23*d* and 23*e* disposed in the upper portion of the multi-layered body 30 are formed in and disposed at two layers. In FIG. 4, the first conductive coil patterns 23*a* to 23*c* and the second conductive coil patterns 23*d* and 23*e* overlap each other at overlapping portions 29 which are edges of the first and second conductive coil patterns 23*a* to 23*c* and 23*d* and 23*e* and which are substantially parallel to each other along lines which are inclined in the widthwise and longitudinal directions of the multi-layered body 30. Therefore, gaps formed between the conductive coil patterns 23*a* and 23*b* and between the conductive coil patterns 23*b* and 23*c* are covered with the conductive coil patterns 23*d* and 23*e*, respectively. In FIG. 4, the overlapping portions 29 are shown as hatched portions.

Figure 5:
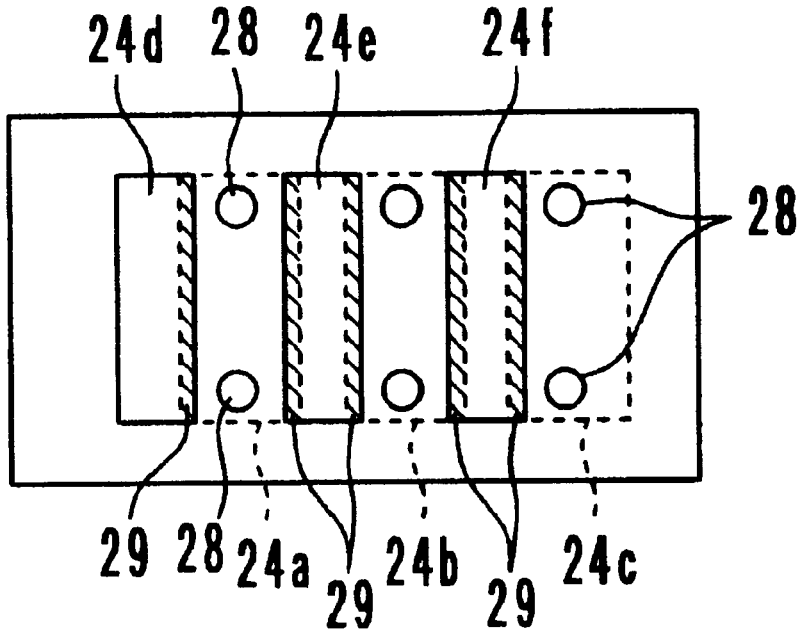
FIG. 5 is an internal plan view showing the position of third and fourth conductive coil patterns.

The third conductive coil patterns 24*d* to 24*f* and the fourth conductive coil patterns 24*a* to 24*c* are formed in and disposed at two layers. In FIG. 5, the third conductive coil patterns 24*d* to 24*f* and the fourth conductive coil patterns 24*a* and 24*c* overlap each other at the overlapping portions 29 which are substantially parallel to each other and to the shorter sides of the multi-layered body 30. Therefore, gaps between the conductive coil patterns 24*a* and 24*b*, between the conductive coil patterns 24*b* and 24*c*, and between the conductive coil pattern 24*a* and the input-output electrode 31 are covered with the conductive coil patterns 24*e*, 24*f*, and 24*d*, respectively.

With this arrangement, the multilayer inductor 21 in which leakage of magnetic fluxes $\phi$ generated by the spiral coil L is decreased and high inductance can be obtained is provided. In particular, according to the first preferred embodiment, the width of the first and fourth conductive coil patterns 23*a* to 23*c* and 24*a* to 24*c*, which are disposed at the outer sides in the stacking direction of the insulation sheets 22*a* to 22*f*, is preferably larger than the width of the second and third conductive coil patterns 23*d* and 23*e*, and 24*d* to 24*f*, thereby reliably suppressing and minimizing the leakage of the magnetic fluxes $\phi$.

A multilayer inductor according to a second preferred embodiment of the present invention differs from the multilayer inductor 21 according to the first preferred embodiment in that the multilayer inductor according to the second preferred embodiment is provided with a nonmagnetic layer between the first conductive coil patterns 23*a* to 23*c* and the second conductive coil patterns 23*d* and 23*e* and another nonmagnetic layer between the third conductive coil patterns 24*d* to 24*f* and the fourth conductive coil patterns 24*a* to 24*c*.

Figure 6:
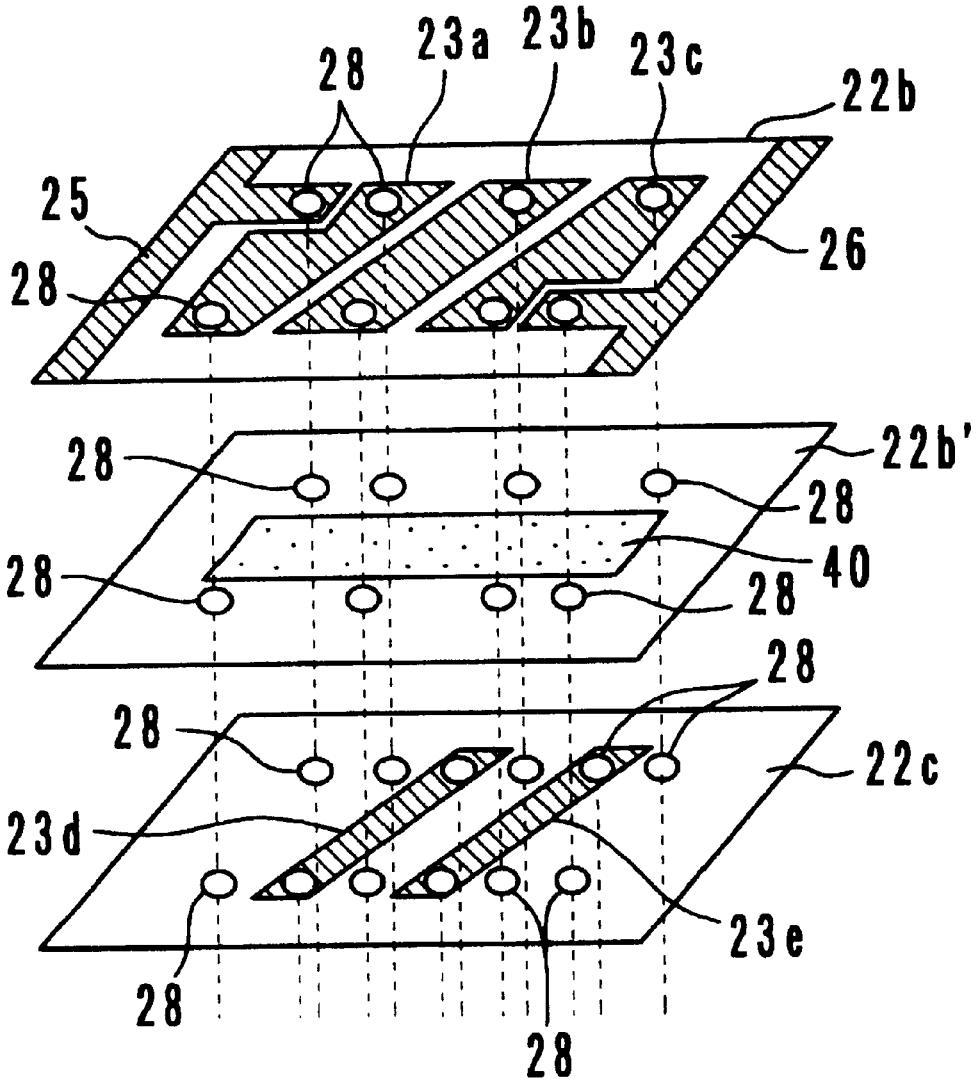
FIG. 6 is an exploded perspective view of a portion of a multilayer inductor according to a second preferred embodiment of the present invention.

In FIG. 6, an insulation sheet 22*b'* having a substantially rectangular nonmagnetic layer 40 located thereon is disposed between the first insulation sheet 22*b* having the first conductive coil patterns 23*a* to 23*c* disposed thereon and the second insulation sheet 22*c* having the second conductive coil patterns 23*d* and 23*e* provided thereon. The nonmagnetic layer 40 is preferably made of glass, a dielectric ceramic, or other suitable material. Another insulation sheet 22*b'* having a nonmagnetic layer 40 located thereon is disposed between the third insulation sheet 22*e* having the third conductive coil patterns 24*d* to 24*f* disposed thereon and the fourth insulation sheet 22*f* having the fourth conductive coil patterns 24*a* to 24*c* disposed thereon. The shape of the nonmagnetic layer 40 is not limited to substantially rectangular, and the size thereof is not limited to that of the region enclosed by the via holes 28. For example, the nonmagnetic layer 40 may be formed on the entire insulation sheet 22*b'*.

Figure 7:
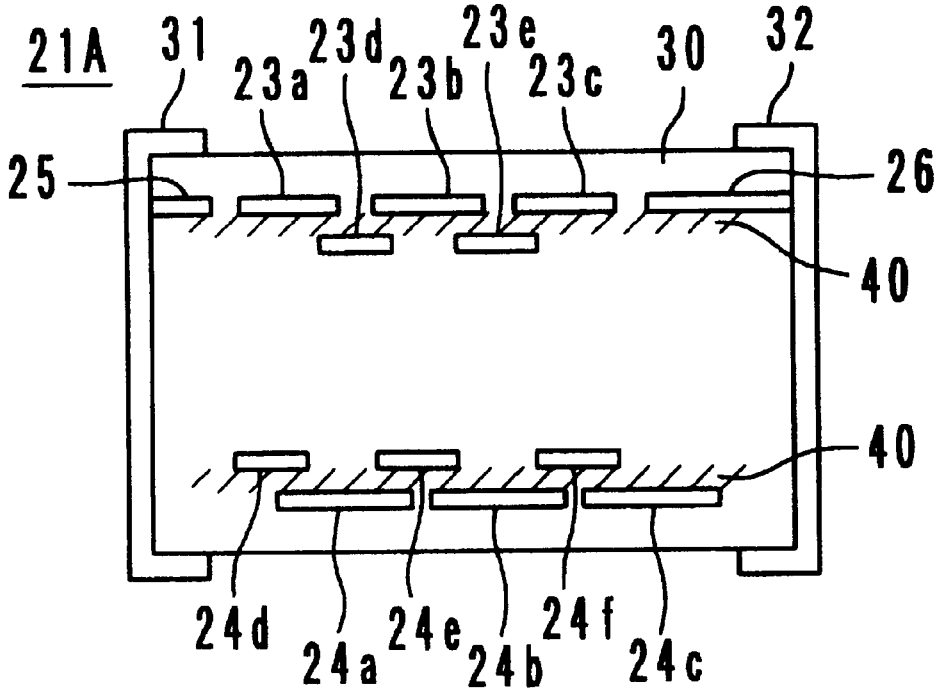
FIG. 7 is a schematic sectional view of the multilayer inductor shown in FIG. 6.

With this arrangement, a multilayer inductor 21A, in which the nonmagnetic layers 40 are individually disposed between the overlapping first and second conductive coil patterns 23*a* to 23*c* and 23*d* and 23*e* and between the overlapping third and fourth conductive coil patterns 24*d* to 24*f* and 24*a* to 24*c*, as shown in FIG. 7, is obtainable. Since no magnetic paths are generated at the nonmagnetic layers 40 of the multilayer inductor 21A, the leakage of magnetic fluxes is decreased even more than in the multilayer inductor 21 according to the first preferred embodiment and higher inductance can be obtained.

The present invention is not limited to preferred embodiments described above, and it may be modified within the spirit and scope of the present invention. Although according to the above-described preferred embodiments, the conductive coil patterns disposed in the upper and lower portions of a multi-layered body are each formed in and disposed at two layers, the conductive coil patterns do not necessarily have to be formed in and disposed at two layers both at the upper and lower portions of the multi-layered body. The conductive coil patterns may be formed in and disposed at two layers in one of the upper portion and the lower portion and those in the other portion may be formed in one layer.

Figure 8:
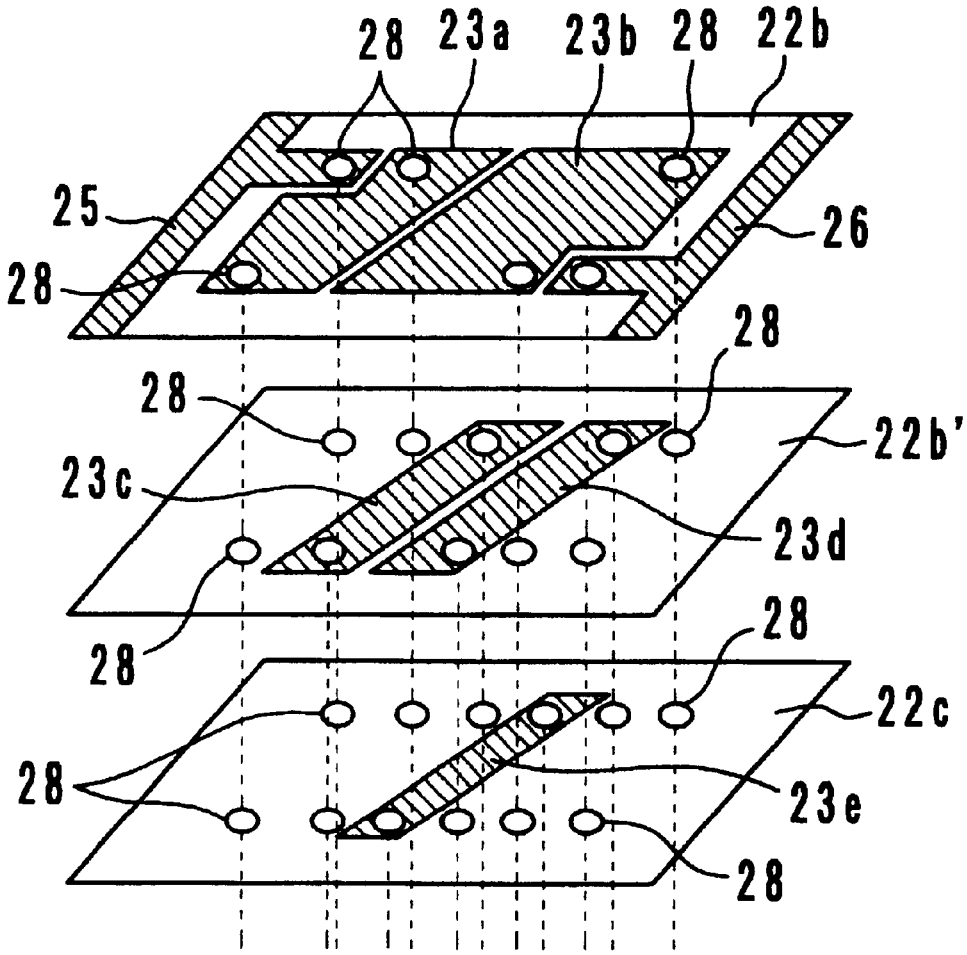
FIG. 8 is an exploded perspective view of a portion of a multilayer inductor according to another preferred embodiment of the present invention.
Figure 9:
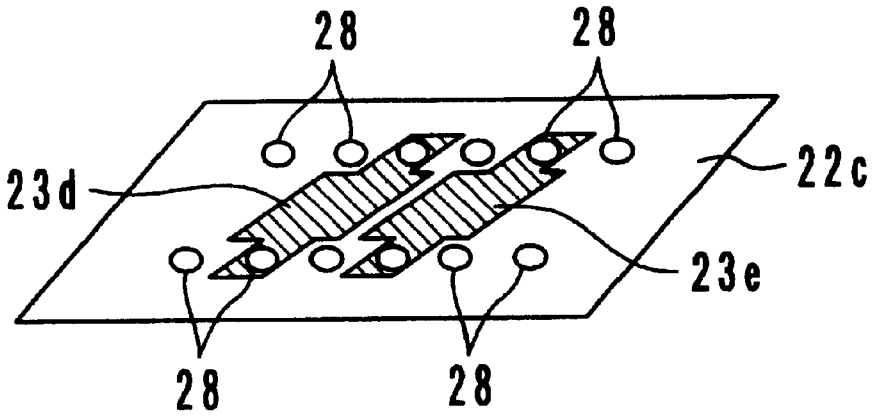
FIG. 9 is a perspective view of a portion of a multilayer inductor according to still another preferred embodiment of the present invention.
Figure 10:
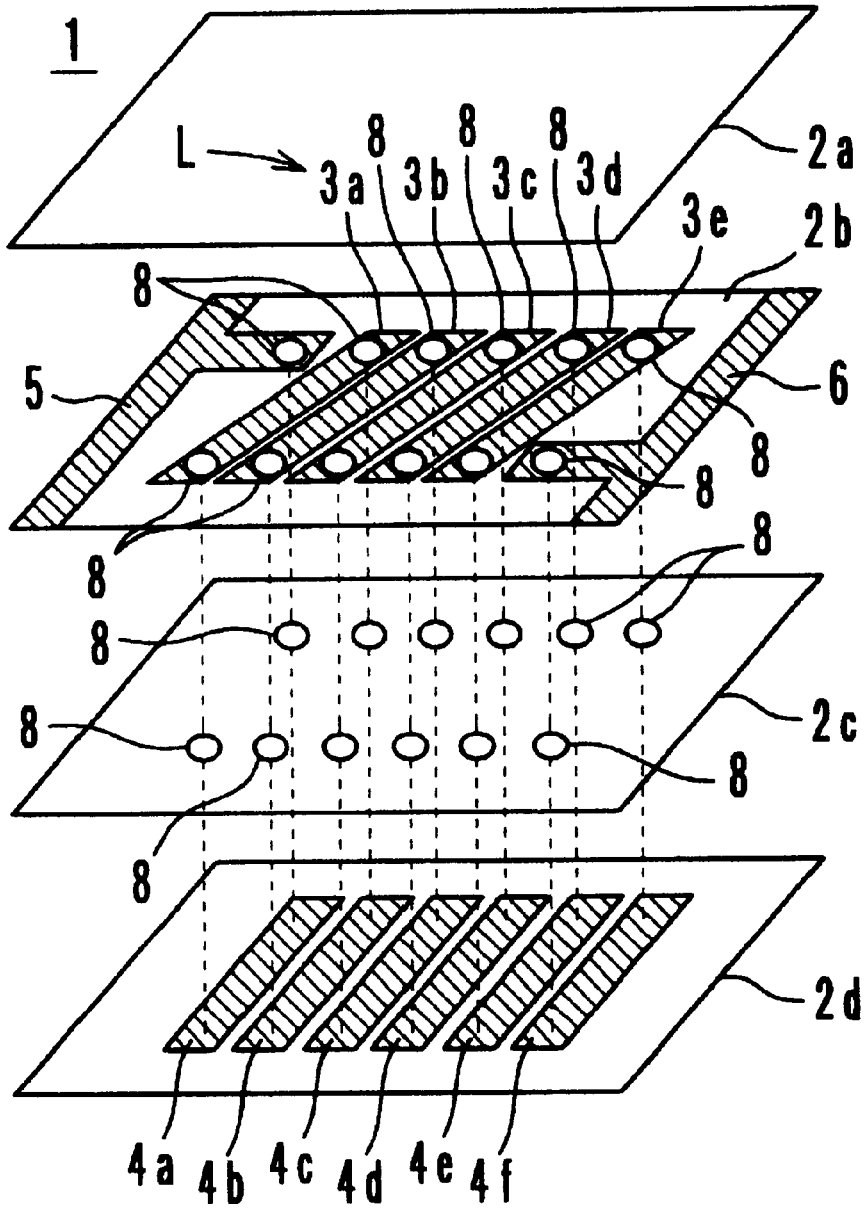
Fig. 10 PRIOR ART
FIG. 10 is an exploded perspective view of a known multilayer inductor.
Figure 11:
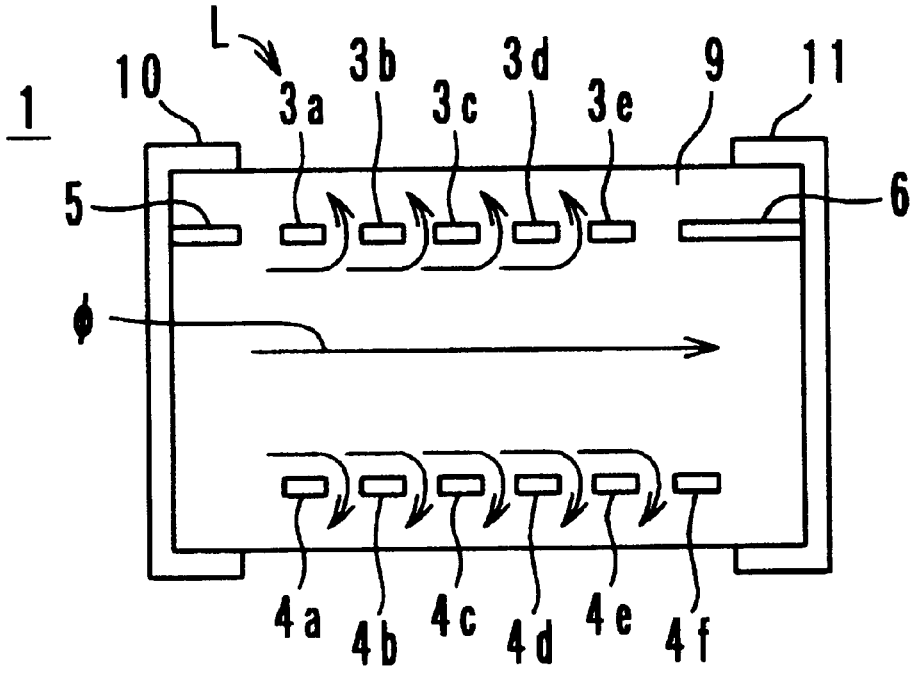
Fig. 11 PRIOR ART
FIG. 11 is a schematic sectional view of the multilayer inductor shown in FIG. 10.

The conductive coil patterns disposed in the upper or lower portion of the multi-layered body may be formed in three layers. In FIG. 8, conductive coil patterns 23*a* to 23*e* disposed in the upper portion of the multi-layered body are formed in three layers. The width of each of the conductive coil patterns 23*d* and 23*e* may be increased, as shown in FIG. 9, so that the overlapping area increases.

The multilayer inductor is not necessarily manufactured such that the insulation sheets provided with the conductive coil patterns and the via holes are firstly laminated on each other, then, are sintered integrally with each other. Insulation sheets, which have been sintered beforehand, may be used. The multilayer inductor may be manufactured by a method described below. That is, an insulation layer is formed of a paste-like insulation material by printing or other suitable process, and a paste-like conductive material is applied to the surface of the insulation layer so as to form conductive coil patterns. Then, the paste-like insulation material is applied to the conductive coil patterns, thereby forming an insulation-layer unit embedded with the conductive coil patterns. In such a manner, the conductive material and the insulation material are alternately applied, and the resulting conductive coil patterns are electrically connected to each other at given portions thereof through via-holes, whereby a multilayer inductor is obtained.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A multilayer inductor comprising:

a multi-layered body including a plurality of insulation layers stacked on each other in a stacking direction and laminated together;

a plurality of conductive coil patterns disposed in an upper portion of the multi-layered body;

a plurality of conductive coil patterns disposed in a lower portion of the multi-layered body; and a plurality of via holes formed in the multi-layered body; wherein the conductive coil patterns disposed in the upper portion and the lower portion of the multi-layered body are electrically connected alternately in series to each other through the via holes so as to define a coil, the axis of the coil is substantially perpendicular to the stacking direction of the insulation layers, a plurality of the conductive coil patterns disposed in one of the upper portion and the lower portion of the multi-layered body is formed in and disposed at different layers of the multi-layered body, and each of the conductive coil patterns formed in and disposed at one of the different layers partially overlaps the conductive coil patterns formed in and disposed at the others of the different layers.

2. A multilayer inductor according to claim 1, wherein each of the pluralities of conductive coil patterns disposed in the upper portion and the lower portion of the multi-layered body partially overlaps the conductive coil patterns formed in and disposed at the others of the different layers.

3. A multilayer inductor according to claim 1, wherein at least one nonmagnetic layer is disposed between said different layers provided with the conductive coil patterns.

4. A multilayer inductor according to claim 1, wherein the width of the conductive coil patterns formed in and disposed said different layers located at an outer portion of said multi-layered body is greater than the width of the conductive coil patterns formed in and disposed at said different layers located at an inner portion of said multi-layered body.

5. A multilayer inductor according to claim 1, wherein the insulation layers are made of one of a magnetic material and an insulative material.

6. A multilayer inductor according to claim 1, wherein the plurality of conductive coil patterns includes at least four conductive coil patterns.

7. A multilayer inductor according to claim 1, wherein the plurality of conductive coil patterns includes at least two conductive coil patterns disposed in the upper portion of the multi-layered body and at least two conductive coil patterns disposed in the lower portion of the multi-layered body.

8. A multilayer inductor according to claim 1, wherein each of the conductive coil patterns formed in and disposed at one of the different layers partially overlaps the conductive coil patterns formed in and disposed at the others of the different layers at edges of the respective conductive coil patterns.

9. A multilayer inductor according to claim 1, wherein the coil conductor patterns are disposed on the insulation layers so as to be inclined relative to the length and width of the insulation layers.

10. A multilayer inductor according to claim 1, wherein the coil conductor patterns are arranged to be inclined relative to the length and width of the multi-layered body.

* * * * *

UNITED STATES PATENT AND TRADEMARK OFFICE

CERTIFICATE OF CORRECTION

PATENT NO. : 6,590,486 B2 
DATED : July 8, 2003
INVENTOR(S) : Tadashi Tanaka and Hiromichi Takuda It is certified that error appears in the above-identified patent and that said Letters Patent is hereby corrected as shown below:

Title page,
Item [*] Notice, delete "This patent is subject to a terminal disclaimer"

Signed and Sealed this

Fourteenth Day of October, 2003

JAMES E. ROGAN
*Director of the United States Patent and Trademark Office*